US007077257B2

(12) United States Patent
Pietz

(10) Patent No.: US 7,077,257 B2
(45) Date of Patent: Jul. 18, 2006

(54) DRIVE SYSTEM FOR REDUCING THE POLYGON EFFECT IN CONTINUOUS DRIVE CHAINS OF ESCALATORS OR MOVING WALKWAYS

(75) Inventor: Alexander Pietz, Berlin (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/971,048

(22) Filed: Oct. 25, 2004

(65) Prior Publication Data

US 2005/0061608 A1 Mar. 24, 2005

Related U.S. Application Data

(63) Continuation of application No. PCT/EP03/04145, filed on Apr. 22, 2003.

(30) Foreign Application Priority Data

Apr. 25, 2002 (DE) ..... 102 18 374
May 24, 2002 (DE) ..... 102 22 992

(51) Int. Cl.
*B66B 21/12* (2006.01)

(52) U.S. Cl. ..... 198/334; 198/330

(58) Field of Classification Search ..... 198/321, 198/330, 334
See application file for complete search history.

(56) References Cited

U.S. PATENT DOCUMENTS

| | | | | |
|---|---|---|---|---|
| 2,940,578 | A * | 6/1960 | Clemetsen et al. | 198/330 |
| 3,903,806 | A * | 9/1975 | Ayres et al. | 198/334 |
| 4,498,890 | A | 2/1985 | Sutherland | |

FOREIGN PATENT DOCUMENTS

| | | |
|---|---|---|
| DE | 443 192 C | 4/1927 |
| DE | 1 829 806 | 4/1961 |
| DE | 7 429 118 | 8/1974 |
| DE | 198 49 236 A1 | 2/2000 |
| EP | 0 711 725 A1 | 5/1996 |
| GB | 354 169 A | 7/1931 |
| GB | 422 184 A | 1/1935 |

* cited by examiner

*Primary Examiner*—James R. Bidwell
(74) *Attorney, Agent, or Firm*—Venable LLP; Robert Kinberg; Ryan M. Flandro

(57) ABSTRACT

A drive system for an escalator or a moving walkway includes at least one drive motor, at least one drive chain and a reversing element for the drive chain. A device for modifying the speed of the drive chain is arranged in at least an entry or exit area of the reversing element.

12 Claims, 3 Drawing Sheets

DRIVE SYSTEM FOR REDUCING THE POLYGON EFFECT IN CONTINUOUS DRIVE CHAINS OF ESCALATORS OR MOVING WALKWAYS

CROSS-REFERENCE TO RELATED APPLICATION

This is a continuation of International Patent Application No. PCT/EP03/04145 filed Apr. 22, 2003, designating the U.S. and claiming priority of German Patent Application Nos. 102 18 374.0 filed Apr. 25, 2002, and 102 22 992.9 filed May 24, 2002, the disclosures of all of the foregoing applications being incorporated herein by reference.

The subject matter of this application is additionally related to the subject matter of the following U.S. Patent Applications: (1) concurrently filed and co-owned application Ser. No. 10,971,789 filed in the name of Alexander Pietz, titled "Drive System For Escalators or Moving Walkways; " (2) Ser. No. 10/728,852 filed Dec. 8, 2003, now U.S. Pat. No. 6,874,613; (3) Ser. No. 10/693,825 filed Oct. 27, 2003, now U.S. Pat. No. 6,892,874; and (4) Ser. No. 10/464,555 filed Jun. 19, 2003.

BACKGROUND OF THE INVENTION

The invention relates to a drive system for escalators and moving walkways.

It is generally known that escalators or moving walkways are indirectly or directly driven by electric motors. For an indirect drive, there is provided at least one reducing gear, and if necessary, power dividers can be additionally provided, in the region of which the components of escalators or moving walkways can be driven together. Such components included the step or pallet band, and the handrail if required and if no separate drive means is provided for the same. The step or pallet band is usually displaced by plate link chains, the direction of movement of which is changed in reversing areas via reversing elements in the form of chain wheels. An essential requirement of escalators and moving walkways is to enable the reversing of the step or pallet band without the undesired polygon effects and to obtain a synchronous running of the step or pallet band and the handrail, when they are driven together, so that one component does not run at a higher or lower speed than the other, which could cause passenger injury.

With a view toward optimization of the drive concept, plate link chains can be used for the step or pallet band, which chains also have a greater pitch depending on the step or pallet width, for example approximately 200 or approximately 400 mm. However, it is possible that these desired greater chain pitches will cause problems with respect to the polygon effect during the reversing and possibly with respect to the synchronous drive of the handrail.

Escalators and moving walkways are furthermore generally known which are intended for indoor use, for example in department stores or the like, and which are provided with drive chains, in which, with regard to the relatively low forces, the step or pallet studs including the rollers, which cooperate with the steps or pallets, are positioned in the respective joint areas of the drive chains. However, during the reversing of the reversing chains, in particular with greater chain pitch, the existing polygon effect causes problems.

German patent document DE-A 19 849 236 discloses a method and a device for guiding a chain in the area of chain wheels of a continuous conveyor system, in particular an escalator or a moving walkway, by supplying the chain to the respective chain or driving wheel in a linear direction. After engagement of a first element of a first chain link of the chain strand with the chain or driving wheel, a continuous adaptation of the effective chain radius is realized, while setting a constant velocity in the chain strand. Preferably, the chain or driving wheel shall be small, in particular in the area of the outer diameter thereof, for receiving the chain studs, wherein at least one rail-like guiding profile is placed in this area, directly beside the chain or driving wheel.

This measure permits an efficient reduction of the polygon effect, but the construction effort both in front of and in the area of the reversing wheel is high.

From German patent document DE-A 0 711 725 a similar device for guiding a band continuum of escalators or moving walkways is disclosed. In this band continuum, the chain rolls are guided by means of a supporting rail with a running path and an equalizing rail with a running path. At the entry of a chain wheel, which reverses the band continuum, the chain rolls run from the linear running path of the supporting rail onto the curve shaped running path of the equalizing rail and from there to a tangent point into engagement with the chain wheel. From the running path of the supporting rail to the tangent point, the chain rolls are guided into a direction orthogonal to the running direction, over a distance which is transverse to the running direction, towards the chain wheel, which has an advantageous effect on the quiet running of the band continuum.

This special curve shape of the connection element helps to reduce the polygon effect. In the reversing of the chains of escalators or moving walkways by means of a chain wheel, polygon and revolution effects occur, which in particular adversely affect the quiet running of the escalator or the moving walkway. The polygon effect is caused by the polygonal rest of the chain on the chain wheel. With increasing rotation angle, the effective radius of the chain wheel varies, whereby the velocity of the chain oscillates between a maximum and a minimum value. When engaging the chain wheel, the chain rolls and the teeth of the chain wheel have different velocities, which cause impacts. The revolution effect is caused by the angular momentum which is transmitted from the chain wheel onto the chain links and thus onto the steps or pallets. After the chain has run out of the chain wheel, this angular momentum is temporarily maintained due to the inertia of the system, which leads to the so called curling of the chain. The angular momentum is reduced by friction in the chain respectively by impacts between chain and guiding element, if a chain guiding element is provided.

SUMMARY OF THE INVENTION

It is an object of the invention to provide a new drive system for escalators and moving walkways, which are in particular equipped with plate link chains having a greater pitch, in which the direction of movement of both drive chains having a normal pitch and drive chains having a greater pitch can be changed in the area of reversing elements with a minimized polygon effect. This can be realized both in the entry and the exit area of the respective drive chain.

The above and other objects are achieved according to the invention by the provision of a drive system for an escalator or a moving walkway, the escalator having steps and the moving walkway having pallets, the system comprising: at least one drive motor; at least one drive chain comprising a plate link chain having chain links; a reversing element for the drive chain; and a device for modifying the speed of the drive chain including respective components thereof in at least one of an entry or exit area of the reversing element.

In comparison to the state of the art, the object of the invention enables efficient elimination of speed differences between the drive chain and the reversing element in the entry area, on the one hand, and optionally also in the exit area, on the other hand. This results from the fact that, in single or several chain links, respectively at least one roller or chain roll of the drive chain is or are moved out of their direction of movement before entering or after leaving the reversing element, which is preferably configured as a chain wheel. The entry/exit area cannot be considered as a point, but it covers a defined area in front of or behind the respective reversing element that is dependent on the chain pitch.

The speed is influenced due to changes of the radii which is dependent on the phase position of the chain wheel. The desired constant speed is thus modified. For chain drives of escalators and moving walkways, the chain is typically guided over a path before the entry into the chain wheel, which path has an almost constant curve shape in the state of the art.

The invention takes advantage of the fact that it is possible to influence the position of the upstream chain links/chain rolls or rollers as a function of the phase position of the chain wheel. In such positions, in which a higher speed is geometrically caused by the chain engagement, the position of one or several of the mentioned chain links, respectively the rollers or chain rolls, shall be influenced by the curved shape of the upstream or downstream path, such that a speed reduction/increase is realised, which, in sum, reduces the speed variations in the entry/exit area of the drive chain. Simultaneously an equalization of the polygon effect is obtained, since the speed adaptations are no more felt as impacts by the users of the escalator or the moving walkway. The quiet running and the life time of the components of the escalator or moving walkway can be considerably increased. The polygon effects, which are caused by the greater chain pitches of the step or pallet chain, and which have a negative effect on the reversing element that is configured as a chain wheel and optionally on the handrail wheel, are almost eliminated by the subject of invention. The economically positive effects of a greater chain pitch (reduction of the chain price) can thus be efficiently integrated into existing drive systems with the use of the invention.

Chain pitches, which actually correspond to the state of the art, are realised with 3 chain links of about 133 mm for each step or pallet for usual step or pallet tread lengths of about 400 mm. The number (z) of peripheral teeth of the reversing elements is adapted thereto, for example with $z=17$, but it can also be different depending on the diameter of the respective reversing element. Due to the high elasticity of the drive chain, the polygon effect can be practically neglected in the dimensioning of the chain, if $z \geqq 19$ and if smaller pitches are provided at higher velocities. However, chain wheels having $z<17$ should only be provided for manual operation or for slowly running chains.

The chain pitch can be principally enlarged in two steps. Under the same conditions (step or pallet tread length of about 400 mm) another possible chain pitch would be 200 mm, on the one hand, and 400 mm, on the other hand, i.e. two links for each step or pallet or one link for each step or pallet. The corresponding teeth numbers of the reversing elements to be used, in particular of the chain wheels, are in this case only about $z=12$ or $z=6$ (depending on the diameter of the reversing element).

The subject of invention can be principally used for all types of escalators or moving walkways, but preferably for the drive chains of an escalator or a moving walkway, which can be used in the interior of buildings. Thus, it is not only the effect of the greater chain pitch, but the combination of the same with suitable measures for reducing the polygon effect, which leads to an economically interesting solution, in particular for drives of department store escalators and moving walkways.

BRIEF DESCRIPTION OF THE DRAWINGS

The subject of invention is represented in the drawing by means of an exemplary embodiment and described as follows. In the drawing.

DETAILED DESCRIPTION OF THE INVENTION

Figure 1:
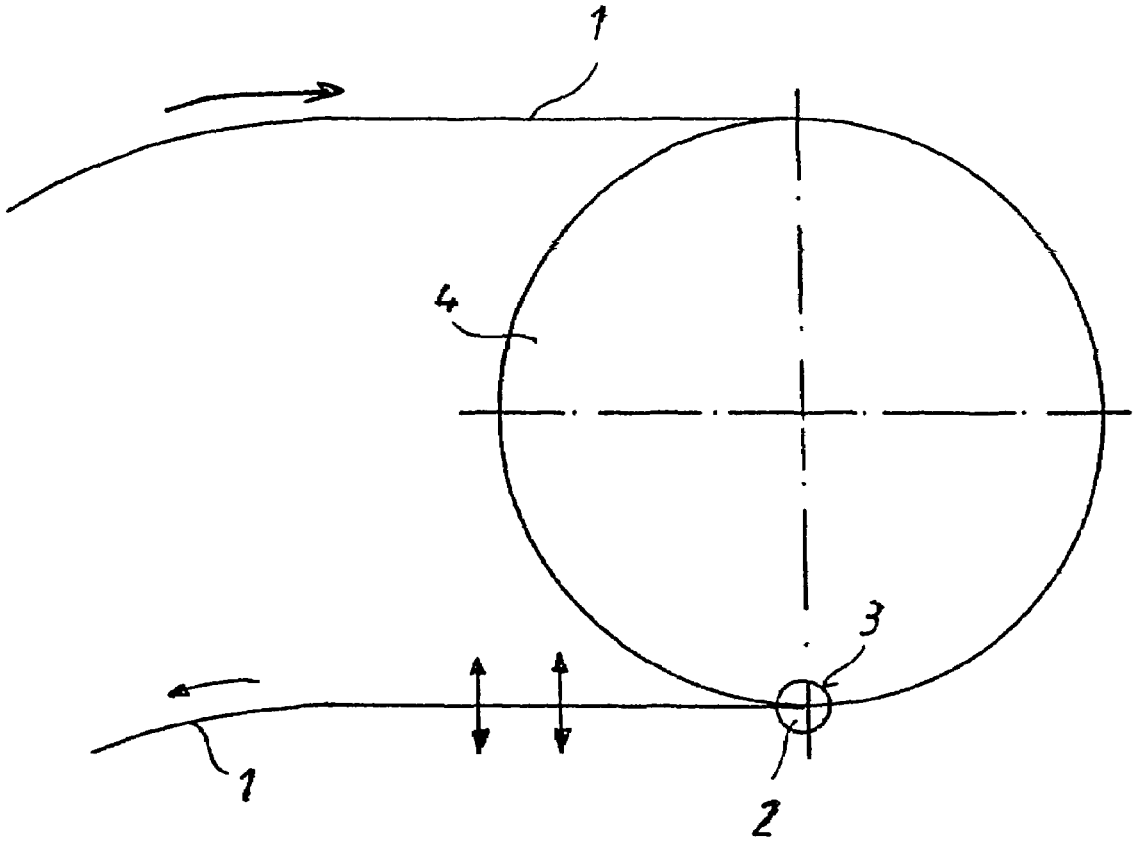
FIG. 1 is a schematic diagram of a reversing area for the drive chain of an escalator.

Referring to FIG. 1, there is shown a reversing area of a drive chain 1 for an escalator (not shown). Drive chain 1 is configured as a plate link chain, having a plurality of chain rolls 2. The direction of movement of chain 1, indicated by the arrows, is changed by a reversing element which is configured as a chain wheel 4 having recesses 3 for receiving the chain rolls. Upon engaging the chain wheel 4, the chain rolls 2 and the teeth of the chain wheel 4 have different speeds, which lead to impacts. The revolution effect is caused by the angular momentum which is transmitted from the chain wheel 4 onto the chain links and thus onto the steps (not represented) of the escalator. After the drive chain 1 has run out of the chain wheel 4, this angular momentum is temporarily maintained due to the inertia of the system, which leads to the so called curling of the drive chain 1

The curling is symbolically represented by the upward and downward arrows shown in FIG. 1. The aforementioned angular momentum is reduced by friction in the drive chain 1 due to impacts between drive chain 1 and a guiding if a chain guiding element is provided. These impacts cause noticeable noise which possibly irritates the user of the escalator, since the user is not able to correctly identify the source or cause of noise.

Figure 2:
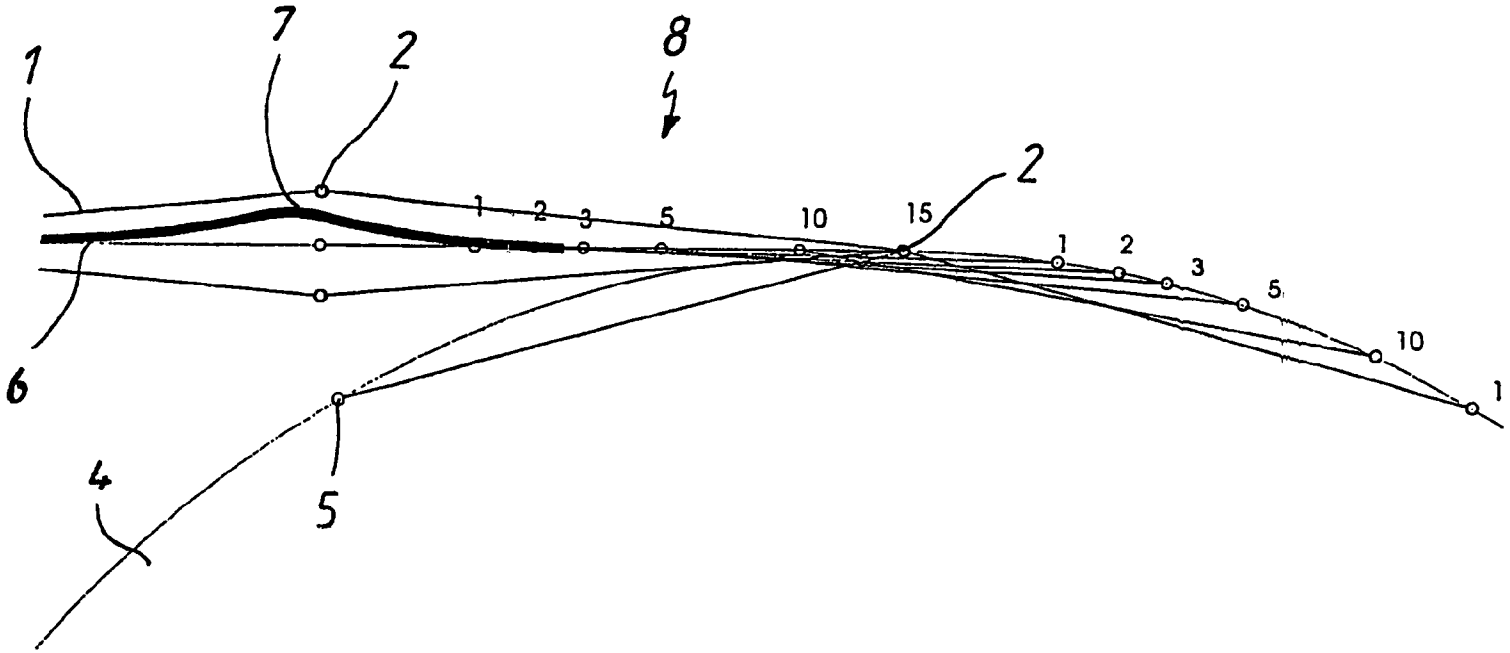
FIG. 2 is a schematic diagram of the drive system according to the invention with respect to the entry area of the drive chain.

FIG. 2 is a schematic diagram of a drive system according to the invention, which, for example, can be used for an escalator. Only the essential components are represented, such as the plate link chain 1, including the chain rolls 2, as well as the reversing element configured as the chain wheel 4 and comprising guiding grooves 5 for the chain rolls 2. According to the invention, a guiding path 6 is provided before the entry of the chain rolls 2 into the chain wheel 4, which guiding path is, in this example, provided with a curve-shaped elevation 7. Since the direction of movement of the chain roll 2 is modified in an upward direction in the area of the curve-shaped elevation 7, the plate link chain 1 is shortened in this area, resulting in a change of speed (v=non-constant) in this area. The phase positions before and after the chain roll(s) 2 have entered the chain wheel 4 are indicated. The subject of invention takes advantage of the fact that it is possible to influence the position of the upstream chain rolls 2 as a function of the phase position of the chain wheel 4. In such positions, in which a higher speed is geometrically predetermined by the chain engagement, at least one of the chain rolls 2 shall be influenced-in its position by the curve-shaped elevation 7 of the guiding path 6, such that a speed reduction or increase is obtained, which altogether reduces the speed variations in the entry area 8 and thus reduces the polygon effect.

Figure 3:
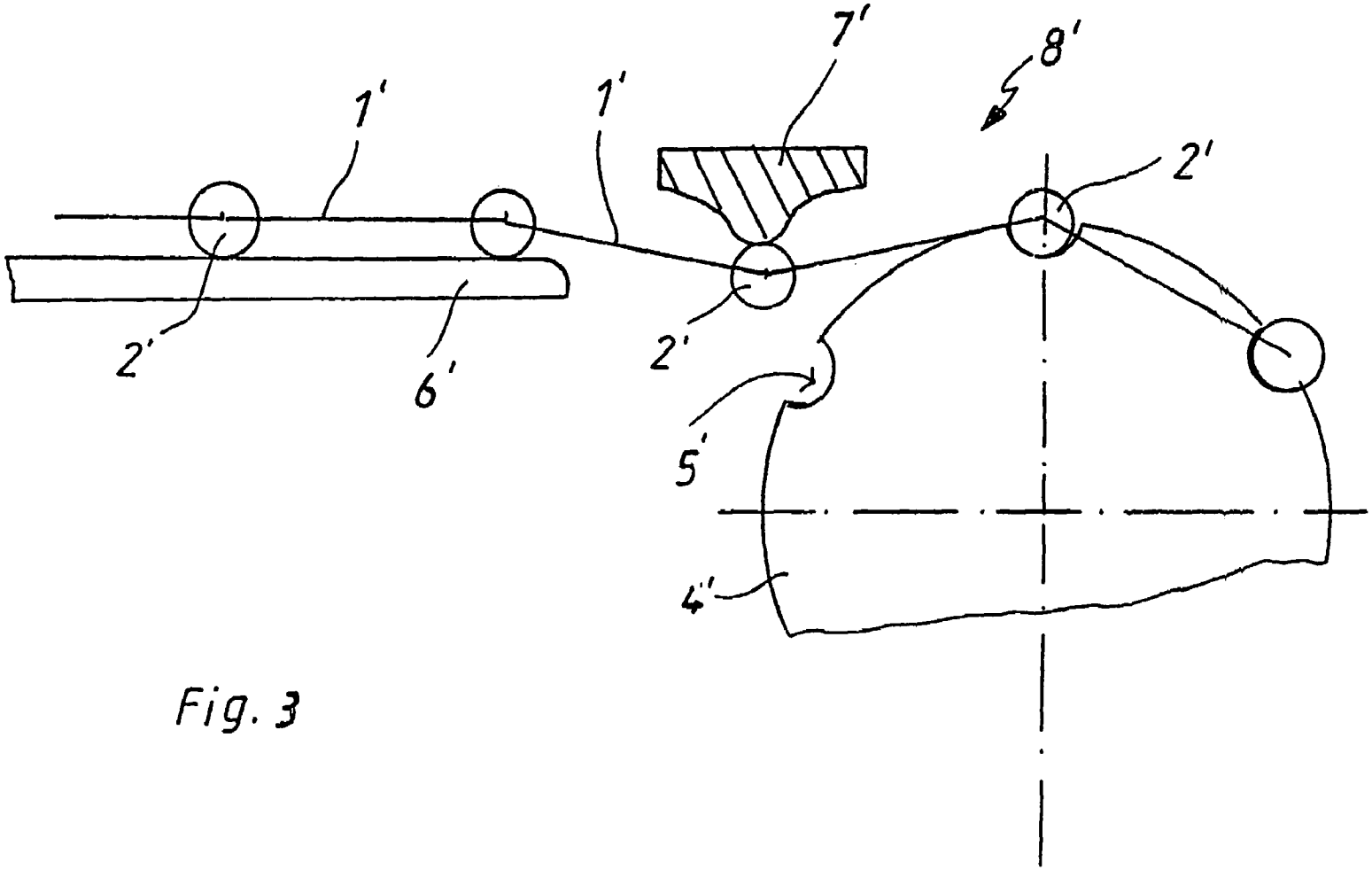
FIG. 3 is an enlarged representation of the area, where the drive chain enters a reversing element.

FIG. 3 shows another possibility to influence the speed of the drive chain 1', also comprising chain rolls 2'. The chain wheel 4' having guiding grooves 5' for the chain rolls 2' of the drive chain 1' is represented. The chain rolls 2' are guided on a guiding path 6', which is provided in the entry area of the drive chain 1', in a linear direction towards the reversing element 4'. Between guiding path 6' and reversing element 4', a curve-shaped device 7' is provided, via which the chain rolls 2' are lowered downwards from the linear direction of movement and thus inserted precisely into the guiding grooves 5' in the entry area 8'. This way of reducing the polygon effect can be used for both drive chains 1' having chain pitches p=133 mm (number of teeth (z) of the reversing element=17) and for chain pitches of p=200 mm (z=12). The economic advantage, due to the reduction of the chain costs, exists for chain pitches of>133 mm.

Figure 4:
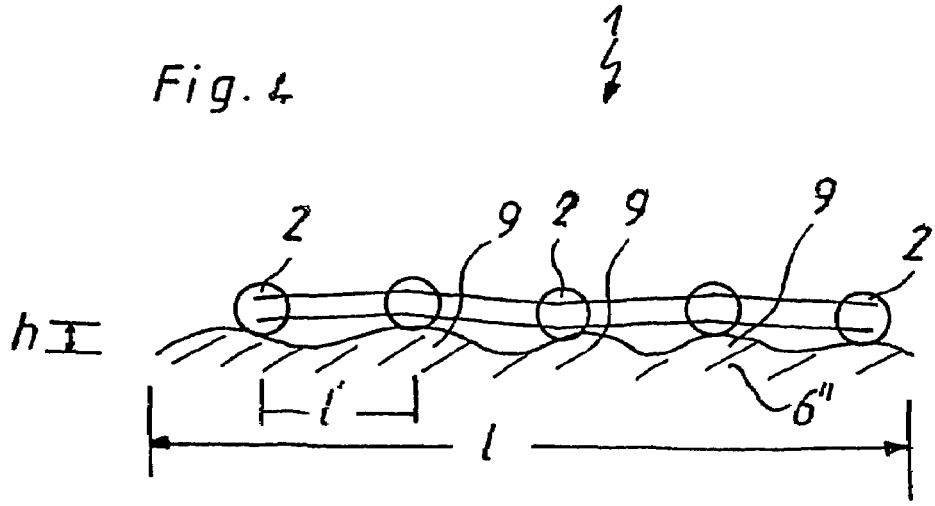
FIG. 4 is a schematic diagram of a guiding path in the exit area of the drive chain.

In FIG. 4, a guiding path 6" is indicated for principal use in the exit area of a reversing element for a drive chain 1. Here the guiding path considers the position of the chain rolls 2 as a function of the phase angle $\phi$ of the chain wheel 4 and adapts it correspondingly, such that a noise reduction is obtained. For this, elevations 9, which depend on the chain pitch, are provided over a pre-determinable distance 1 in the area of the guiding path 6". The height h of the elevations 9 is a function of the phase angle $\phi$ of the chain wheel 4 and simulates the upward and downward movement of the drive chain 1, which is caused by the curling of the drive chain 1 in the exit area. The height h of single elevations 9 can be different, depending on the angular momentum to be reduced and seen in the direction of movement of the drive chain 1, i.e. it can be optionally reduced in the direction of movement of the drive chain 1. Herein, the distance 1' of the elevations 9 is adapted to the respective chain pitch of the drive chain, which is used.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed:

1. A drive system for an escalator or a moving walkway, the escalator having steps and the moving walkway having pallets, the system comprising:

at least one drive motor;

at least one drive chain comprising a plate link chain having chain links and chain rolls, the drive chain having a pitch such that there is a maximum of two chain links for each step or pallet;

a reversing element for the drive chain; and a device for modifying the speed of the drive chain including respective components thereof in at least one of an entry or exit area of the reversing element, wherein the device is adapted to guide at least one chain link or at least one chain roll out of a direction of movement of the chain to a pre-determinable extent in an area of the reversing element.

2. The drive system according to claim 1, wherein the drive motor cooperates with a gear.

3. The drive system according to claim 1, wherein the device comprises a guiding path and means for reducing the efficient chain length in an area of the guiding path, the guiding path being arranged in a transport area of the escalator or the moving walkway and placed before the reversing element, seen in the direction of movement of the drive chain.

4. The drive system according to claim 3, wherein the guiding path includes at least one curve-shaped elevation via which the respective chain link or chain rolls are guided upwards.

5. The drive system according to claim 3, wherein the guiding path includes at least one curve-shaped element via which the respective chain links or chain rolls are guided downwards.

6. The drive system according to claim 3, wherein only the respective chain link or chain roll which engages in the reversing element is guided out of its direction of movement before engagement thereof.

7. The drive system according to claim 1, further including step rolls connected to the chain, and wherein the device includes a guiding path in an exit area of the reversing element via which the chain or step rolls connected to the drive chain are guided out of their direction of movement over a pre-determinable distance and to a pre-determinable extent.

8. The device according to claim 7, wherein the guiding path includes a profile.

9. The device according to claim 8, wherein the profile enables an adaptation of a position of the chain or step rolls depending on a phase angle ($\phi$) of the reversing element.

10. The device according to claim 8, wherein the profile includes elevations which are arranged at a pre-determinable mutual distance seen in the direction of movement of the drive chain.

11. The device according to claim 10, wherein the distance of the elevations is adapted to the pitch of the drive chain.

12. The device according to claim 10, wherein the elevations have a height that decreases as seen in a direction of movement of the drive chain.

* * * * *